US005464136A

United States Patent [19]

Eddy

[11] Patent Number: 5,464,136

[45] Date of Patent: Nov. 7, 1995

[54] SUPPORT BELT FOR COMPETITIVE SHOOTERS

[76] Inventor: Tillman L. Eddy, 1501 39th St., West Palm Beach, Fla. 33407

[21] Appl. No.: 313,762

[22] Filed: Sep. 28, 1994

[51] Int. Cl.[6] ..... A45F 5/00

[52] U.S. Cl. ..... 224/252; 224/240; 224/224; 224/226; 224/901; 224/911; 2/308; 2/312; 2/311; 2/321; 2/322; 2/338

[58] Field of Search ..... 2/308, 311, 312, 2/321, 322, 920, 338; 224/240, 911, 912, 252, 253, 224, 226, 901; 128/99.1, 100.1, 101.1, 102.1; 602/19, 20

[56] References Cited

U.S. PATENT DOCUMENTS

| | | | |
|---|---|---|---|
| 1,600,027 | 9/1926 | Welsand | 224/904 |
| 3,664,560 | 5/1972 | Perkins | 224/5 R |
| 4,294,385 | 10/1981 | Rogers | 224/240 |
| 4,398,655 | 8/1983 | Perry | 224/191 |
| 4,747,527 | 5/1988 | Trumpower, II | 224/224 |
| 4,898,310 | 2/1990 | Remington | 224/238 |
| 4,957,231 | 9/1990 | Kalisher | 224/151 |
| 4,991,573 | 2/1991 | Miller | 128/78 |
| 5,201,448 | 4/1993 | Schue | 224/253 |
| 5,236,113 | 8/1993 | Wisser | 224/243 |

*Primary Examiner*—Henry J. Recla
*Assistant Examiner*—Timothy L. Maust
*Attorney, Agent, or Firm*—Malin, Haley, DiMaggio & Crosby

[57] ABSTRACT

A shooter's support belt that can be used by competition shooters, police officers, service personnel, security officers and others to simultaneously support a wearer's lower back while virtually immobilizing an outer gun holster and belt to increase gun draw speed, whereby the support belt provides a relatively stiff support platform having hook and loop fastening material permanently attached between the belt ends and a fastening strap extending from one end lined on both sides with hook and loop fastening material so that 360° of hook and loop fastening material is always provided for releasably attaching an outer belt and holster system having a corresponding hook and loop liner.

15 Claims, 5 Drawing Sheets

SUPPORT BELT FOR COMPETITIVE SHOOTERS

BACKGROUND OF THE INVENTION

1. Field of the Invention

The present invention relates generally to a holster support belt for supporting and securing gun holsters, tool belts and similar pouch systems, and more particularly, to a competition shooter's holster support system which provides an improved platform for securing and stabilizing a shooter's belt and holster attachment while supporting their lower back.

2. Description of the Background Art

Police officers, cadets, security personnel and competition shooters often experience lower back pain and injuries while shooting and moving through field courses because of inadequate back support. Long hours are spent carrying heavy equipment and shooting in various positions which places excessive stress and strain on the lumbar region of the back. As a result, old injuries are aggravated and new ones incurred by this additional pressure placed on the spine and surrounding muscles. To alleviate stress and strain in the lumbar region, the lower back requires flush support and stability not available with conventional holster systems. That is, conventional holster systems do not facilitate simultaneous use with lower back support devices, such as weight belts used by weight lifters, wherein the holster belt must be worn around the shooter's waist for quick weapon accessibility preempting the use of back support belts.

An additional problem with typical holster systems noted by officers and competition shooters is the lack of stability provided to the actual gun holster. Movement in the holster impairs weapon accessibility when the hand reaches for the gun, produces undesired holster movement as the shooter is running or getting into position and imposes a drag force on the gun as it is being drawn. By providing a virtually motionless holster, mobility of the shooter can be improved and draw times can be decreased by several tenths of a second. Although a fraction of a second may seem negligible, it can make the difference to a competition shooter in winning a competition, and more importantly, to saving an officer's life. Therefore, a support platform capable of stabilizing a shooter's gun holster while supporting their lower back would be well received.

Several holster systems and utility belts exist in the background art, none of which provides or suggest a structure for increasing the stability of a belt holster system while providing therapeutic back support to a shooter's lumbar region. Some of the conventional belt devices known provide support for the pants and exterior holster system attachments, but they do not integrate the functions of a back support belt and holster stabilizing platform. Other support belts perform a broad range of functions which may include supporting the back, but these belts do not simultaneously immobilize a gun holster and protect the lower back. For example, Schue, U.S. Pat. No. 5,201,448, discloses a utility belt for construction workers comprising an elongated belt having a wide mid portion for back support, a buckle mounted on one end and a pair of slots formed along the longitudinal axis of the belt for receiving and hanging a pair of slidable pouches. Kalisher, U.S. Pat. No. 4,957,231, teaches a tackle box belt comprising a waist belt to which a plurality of pockets and loop hangers are mounted for carrying fishing accessories. Remington, U.S. Pat. No. 4,898,310, discloses a center of gravity holster which supports a pistol holster within the small of the back to conceal the weapon while maintaining access thereto. Trumpower, II, U.S. Pat. No. 4,747,527, teaches a utility belt formed from an elongated strip of plastic material having trim molding, open cell foam lining and a plurality of snap lock assemblies for attaching tool holders. Finally, Miller, U.S. Pat. No. 4,991,573 discloses a support belt having two layers of elongated rectangular panels housing therebetween a semi-rigid cushion extension pad with a V-shaped groove for protecting the lumbar region of the back and a strap and buckle system. By contrast, the present invention provides 360° of hook and loop fastener disposed on a stable platform that immobilizes a holster to increase gun draw speed while supporting the lower back to prevent back injuries and discomfort.

The above noted background art neither solves nor addresses the problems contemplated by the present invention. Therefore, their remains a need for a support belt capable of preventing lower back injuries while decreasing pistol draw time for police officers, competition shooters, etc. The present invention solves these problems by providing a support holster system which provides a stable rigid body for supporting the lower back and a fastener design for securely fastening and immobilizing a holster system.

SUMMARY OF THE INVENTION

It is an object of the present invention to provide a support holster system for competitive shooters which supports the lower back in various shooting positions while rigidly securing an outer belt and holster attachment, thereby simultaneously preventing back injury and increasing gun draw speed.

It is another object of the invention to provide a support holster system comprising a pistol competitor's weapon system stabilizing platform, that is, a support belt, for use with conventional speed holster systems to stabilize pistol holsters and magazine pouches for increasing the mobility of the shooter, and improving draw time.

It is a further object of this invention to provide a virtually motionless support holster system that maintains holster grip positioning while the hand moves to the draw so as to allow for quicker acquisition of the weapon.

It is also an object of the invention to provide a support holster system including a support belt that can be used by shooters having a broad range of waist sizes for alleviating stress to the back while immobilizing the holster.

It is yet another object of the invention to provide a support holster system including a support belt that can be used to support and virtually immobilize gun holsters, tool belts, utility belts and similar pouch systems while alleviating stress to the back wherein the foregoing may be achieved by incorporating the required structure to the belts as discussed heretofore.

In accordance with these and other objects, the preferred embodiment of the shooter's support holster system comprises at least a first or inner support belt having a hook and loop fastener, such as Velcro™, permanently affixed to the outer surface of the support belt for attaching an outer belt and holster system having a corresponding hook and loop mating fastener on its inner surface. For a back support belt to work it must be placed flush and tight around a person's waist which normally makes it impractical, if not impossible, to wear a conventional holster. The hook and loop fastener running along the exterior of the support belt allows a holster and belt system having a corresponding hook and loop mating belt liner to be securely attached to the support belt, such that the wearer receives lower back support with the additional benefit of a virtually immobilized holster. Moreover, the support belt with its exterior fastener system may be compatible with all outer belt systems, such as utility belts, capable of utilizing hook and loop type attachment on its interior surface for effectuating secure, stabilized attachment to the support belt.

The support belt is generally flexible along its length but maintains a substantially stiff, 4–6 inch wide, midsection between opposite end portions that provides the user with a combination of increased stability for the pistol holster and for other pouches, such as cartridge pouches, as well as back support in the lumbar region. The stiffness and width of the midsection reduces vertical compression and tension, as well as muscular and ligament strain in the lumbar region while shooting in various positions and moving through field courses. Thus, the midsection wraps around the lower torso to help support and control the movement of the torso thereby reducing lower back pain and injuries, and providing the body with more comfortable mobility.

Complete outer belt stability is also achieved by the present invention which offers 360° of releasable hook and loop fasteners around the support belt for mating with the hook and loop fastener found on the outer belt's inner surface. The 360° of hook and loop fastening material together with the width and rigidity of the belt midsection facilitate precise and secure attachment of the outer belt for a stabilized holster system. Stabilizing the outer holster and belt with the support belt and fasteners helps to effectuate the quickest draw time of a weapon by making the holster virtually motionless so that the holster and grip of the gun remain stationery as the shooter grabs and draws the gun. By improving the stability of the holster, the pistol grip maintains its position as the shooter moves his hand to draw the weapon, allowing for faster acquisition of the weapon. This accurate and stable positioning of the holster makes it possible to reduce draw times by over three-tenths of a second, depending on the level of expertise of the shooter, which skilled shooters consider as time that can make the difference between winning and losing a match. More importantly, however, facilitating faster draw times can also prove beneficial in saving the lives of law enforcement officers.

In the preferred embodiment, the holster support system further comprises a fastening strap permanently attached to the belt and extending beyond one end of the belt. The fastening strap is also furnished with hook and loop lining on both its surfaces so that the strap releasably attaches to the support belt fastener on one side and the second belt fastener on the other side when securing the belt around a wearer's waist and mounting a holster-belt attachment to the support belt, respectively. The fastening strap may be an individual piece affixed to the support belt or it may be an extension of the first hook and loop fastener lining found on the outer surface of the support belt. In either structure, the fastening strap requires the proper hook or loop lining on the side that requires adaptable mating attachment to the support belt hook and loop fastener. On the opposite side, the fastening strap is typically lined with the same type of hook and loop fasteners found on the outer surface of the support belt so that when the strap is secured into position 360° of hook and loop fastener lining is available for the mating attachment of outer belt and holster combinations.

In addition, the present invention preferably includes an additional securing member comprising at least one buckle or attaching ring permanently secured to the outer surface of the belt for receiving the fastening strap when securing the support belt around the shooter's waist. The fastening strap is fed through the ring and pulled back against the buckle, over itself and the outer surface of the support belt to draw in both ends of the support belt snugly around the shooter's waist. The fastening strap makes a mating connection with the hook and loop support belt fastener to secure the support belt on the user's waist while maintaining 360° of hook and loop fastening material. Additional attaching rings may also be permanently attached to the support belt's outer surface for receiving the outer belt being mounted or for attaching accessories.

In accordance with these and other objects which will become apparent hereinafter, the instant invention will now be described with particular reference to the accompanying drawings.

DESCRIPTION OF THE PREFERRED EMBODIMENTS

Figure 1:
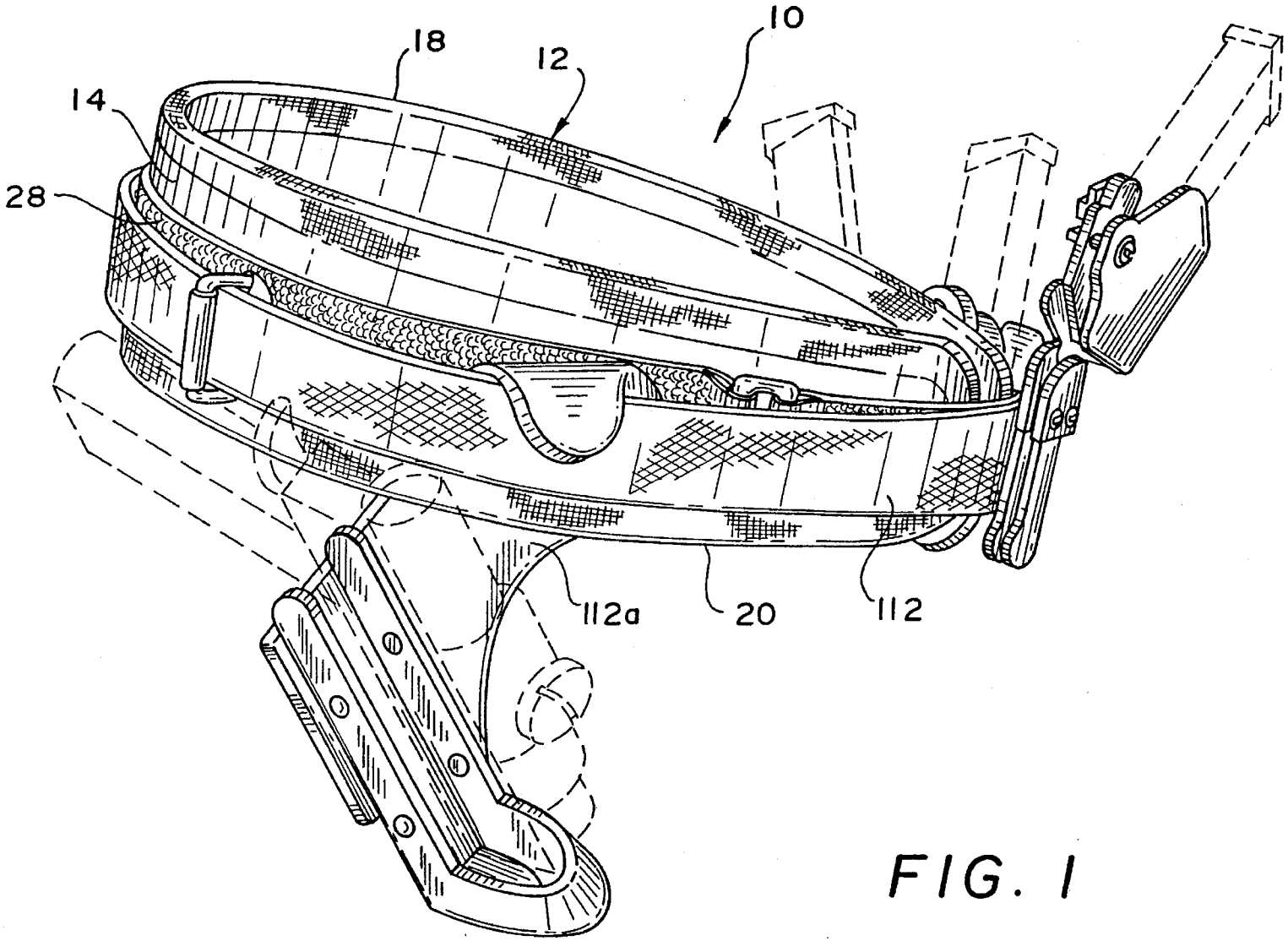
FIG. 1 shows a perspective view of the preferred embodiment of the support belt holster system illustrating the outer belt and holster attached to the support belt.

FIGS. 1–6 show a support holster system 10 for competitive shooters which supports the shooter's lower back while securing in stable position an outer belt and holster attachment 100 for increasing gun drawing speed. In the preferred embodiment, the shooter's support holster system 10 comprises a first or inner support belt 12 having a hook and loop fastener 28 permanently affixed to the outer surface 14 of support belt 12, a fastening strap 30 extending beyond a first end 24 of the belt 12 wherein the strap 30 includes hook and loop fasteners on both its inner side 34 and outer side 32 and at least one buckle 40 permanently affixed to the belt's outer surface 14 near a second end 26 of the belt for receiving the strap 30. The fastening strap 30 is fed through the buckle 40 and pulled back against the buckle 40, over the inner side 34 and the belt's fastener 28 such that 360° of either hook or loop fastener 28 is achieved. Preferably, the strap outer side 32 and the fastener 28 on the belt's outer surface 14 each comprise hook lining while the strap inner side 34 and the outer belt inner surface 116 are lined with loop fastener **34*a*, 128. However, the linings may be reversed whereby the support belt 12 provides loop so that the outer belt 112** requires hook, so long as hook and loop mating attachment is accomplished.

Referring to FIG. 1, an outer belt 112 having a loop fastener liner 128 (shown in FIG. 2) is matingly attached to the outer surface 14 of the support belt 12 via the corresponding hook lining defined by fastener 28 and the outer side 32 of fastening strap 30. The support belt 12 provides a stable platform for the outer belt and holster attachment 100, as shown, such that the holster is virtually immobilized for quicker draws and the lower back is provided support. In addition, FIG. 1 shows that the support belt secures additional pouch attachments, as well.

Figure 2:
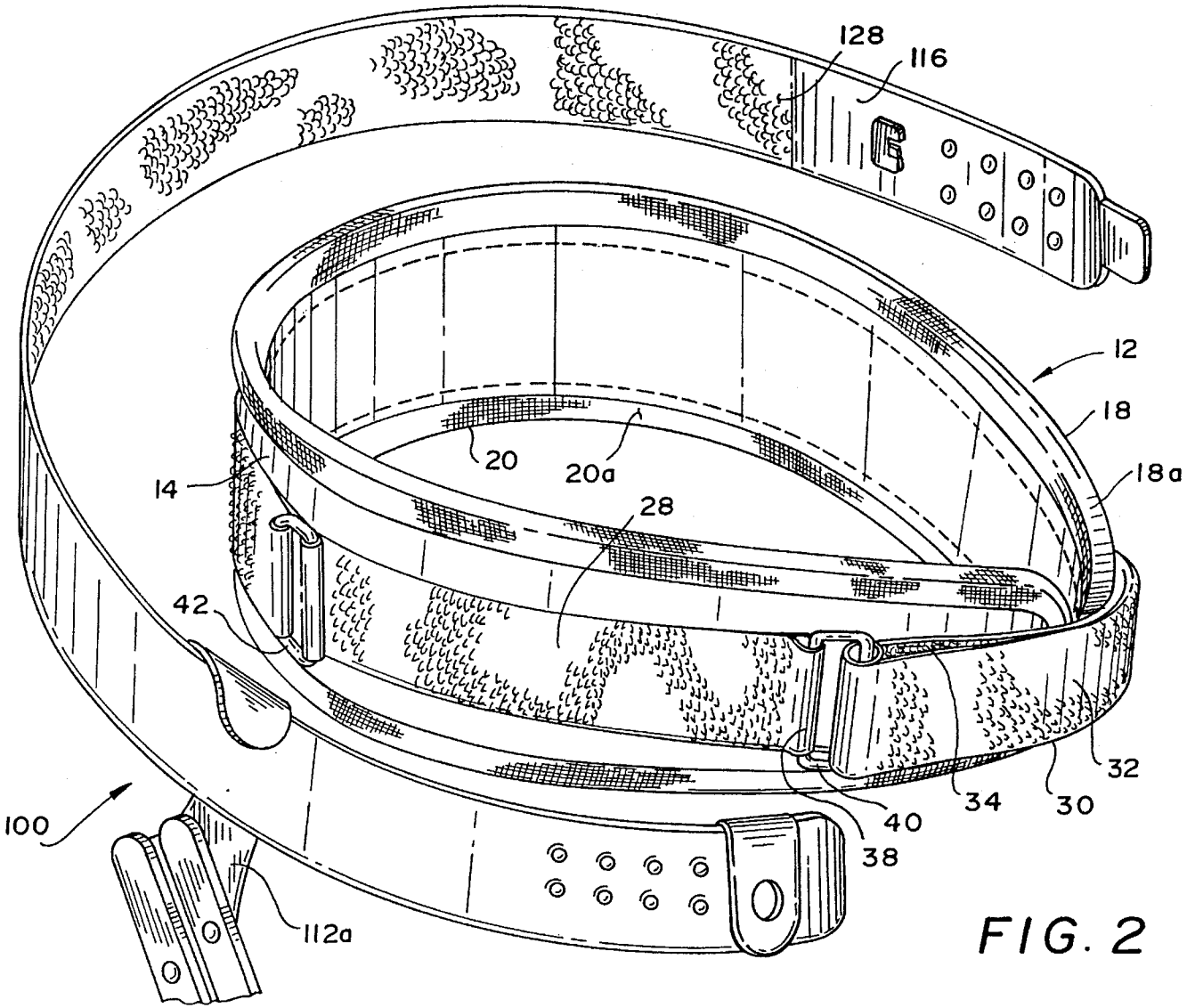
FIG. 2 is an exploded perspective view of the preferred embodiment of the support belt holster system illustrating the hook and loop attachment of the outer belt and holster to the support belt.

With reference to FIG. 2, the outer belt 112 and holster 112*a* is shown detached from the support belt 12, illustrating corresponding hook and loop fasteners 128, 28. Support belt fastener 28 comprises approximately 360° of hook lining while the outer belt 112 is similarly lined with loop fastener 128 such that complete attachment is achieved. As shown, the hook and loop linings on the first and second belts 12, 112 extend longitudinally along the belts and are preferably centrally located so that when aligned the second, or outer belt receives the full benefit of platform support from the first, or inner belt 12. The support platform 12 also has a greater surface area which more fully engages the actual gun holster so that it may be held more firmly in place by the support belt 12 and the outer belt 112 to inhibit its movement. By providing fastening material, such as hook in the preferred embodiment, completely around the support belt 12, the belt and holster attachment 100 can be completely secured along virtually all points if the outer belt is properly lined. That is, the outer belt and holster arrangement 100 may comprise a variety of styles so long as the interior surface is lined with the proper hook and loop fastener for releasably attaching to the support belt 12.

Figure 3:
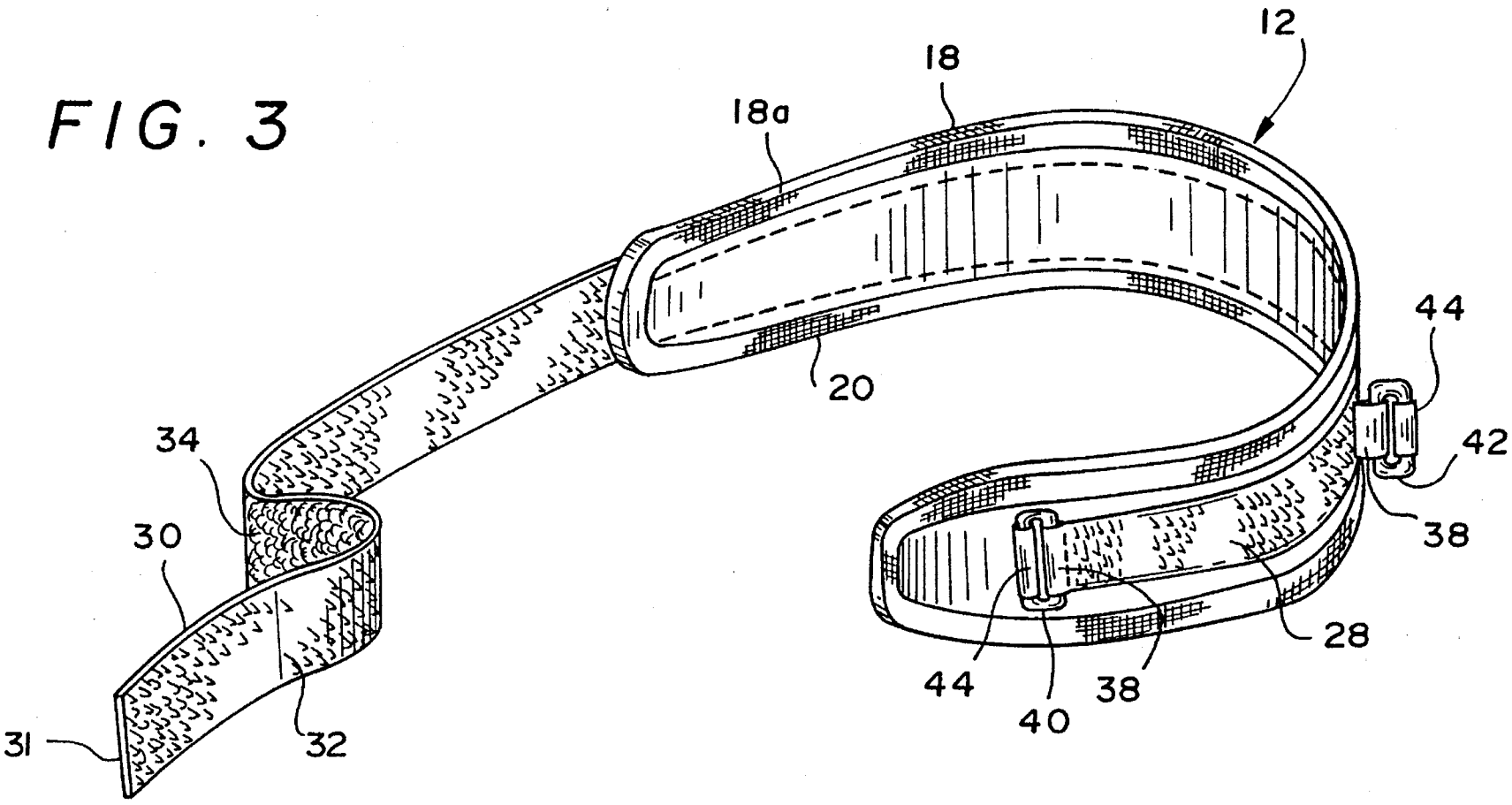
FIG. 3 is a perspective view of the preferred embodiment of the support belt.
Figure 5:
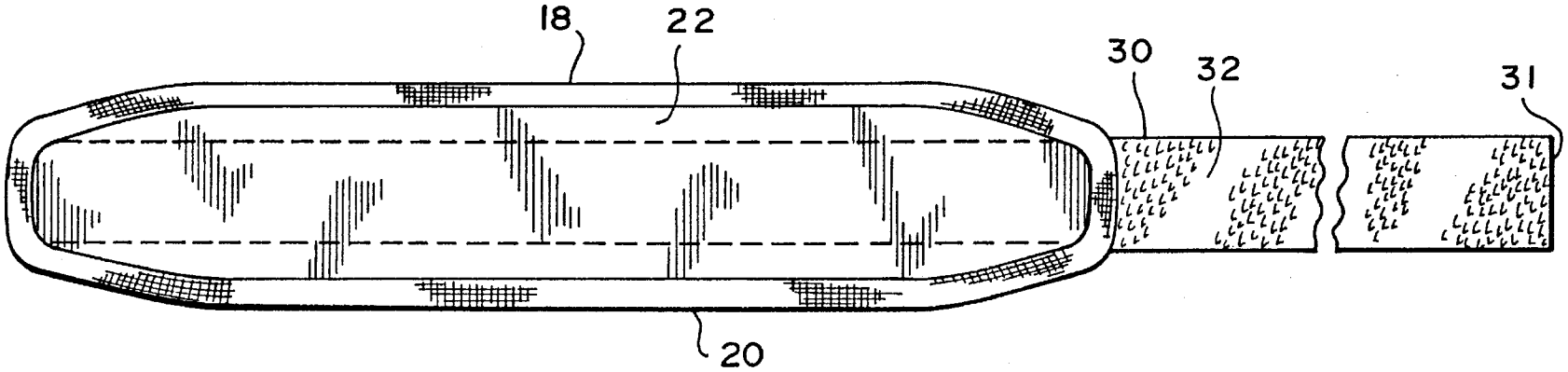
FIG. 5 is a back elevational view of the support belt elongated, illustrating the hook fastener on the outer side of the fastening strap.
Figure 4:
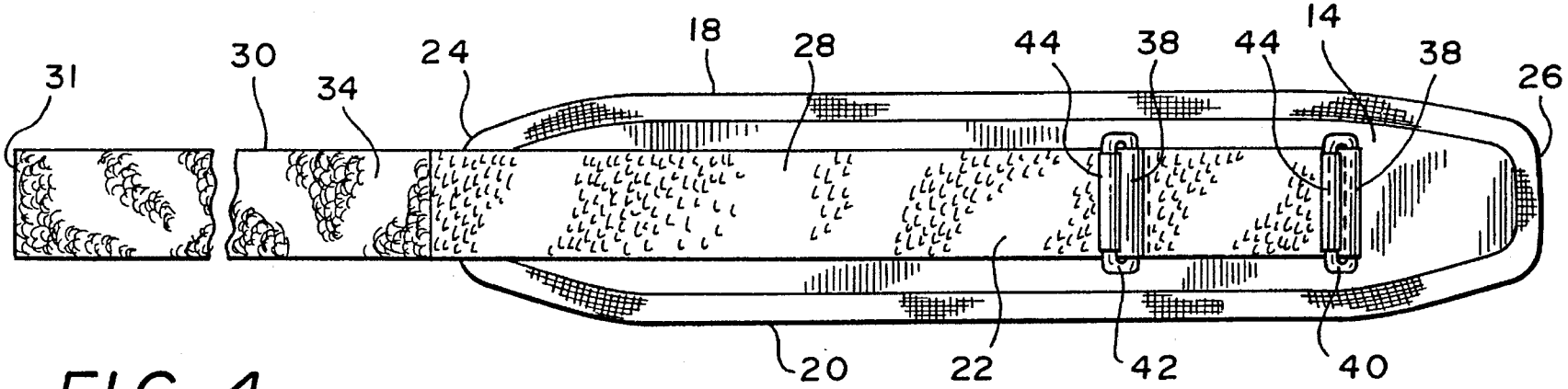
FIG. 4 is a front elevational view of the support belt elongated, illustrating the hook fastener on the outer surface of the belt and the loop fastener on the inner side of the fastening strap.
Figure 6:
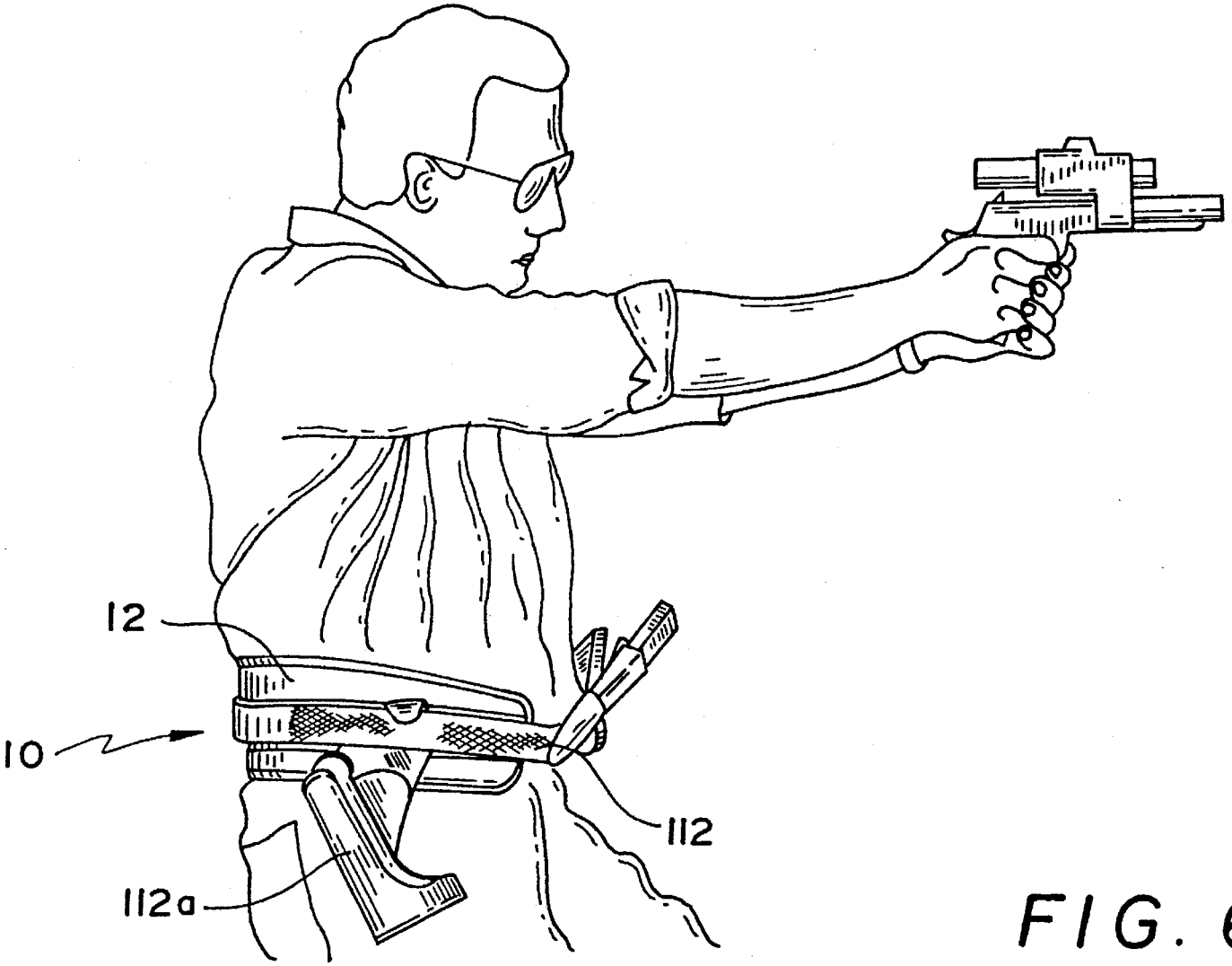
FIG. 6 is a side view of a person wearing the support belt with a holster and belt attachment.

Referring to FIGS. 3–5, the support belt 12 is generally flexible along its longitudinal axis for engaging the lower torso in the lumbar region and relatively rigid across its width between an upper edge 18 and a lower edge 20 to provide requisite back support and holster stability when the belt and holster combination 112 is mounted to the support belt 12. The support belt 12 is dimensioned to accommodate waist sizes ranging from twenty six through forty two inches (26–42"), but may be longer for fitting sizes up to fifty six inches (56"). The support belt 12 is able to accommodate smaller waist sizes because the belt may be overlapped and still provide necessary back support and a full range holster and belt fastening surface, as represented by 28, 32. As shown in FIG. 3 and 4, the hook and loop fastener may be permanently affixed to the belt's outer surface 14 by stitching. In addition, the upper and lower edges 18, 20 and the end portions 24, 26 may include an edge guards 18*a*, 20*a* to protect the belts edges, whereby the guard would provide protective molding around the support belt's peripheral edge to prevent fraying and other damage.

In the preferred embodiment, the support belt first end 24 and second end 26 are drawn sufficiently in, one end towards the other, until a secure fit is achieved by the wearer. A rigid, or substantially stiff midsection 22 is defined between the first and second ends 24, 26 which actually provides the required lumbar support and holster stability for the shooter. The midsection 22 is preferably four to six inches (4–6") in width and tapers off slightly from this dimension as the midsection 22 blends into the end portions 24, 26. Thus, the end portions 24, 26 wrap around the lower torso and are positioned in the abdominal area while the midsection 22 extends from the ends 24, 26, around the oblique muscles and waist, and behind the back so that adequate support is provided the lumbar region. The end portions 24, 26 are tapered compared to the midsection 22 so that the shooter may still bend at the waist when the ends 24, 26 are pulled in toward each other so as to have free movement while shooting or moving through field courses. It should be noted, however, that the support belt 12 may be designed so that the belt 12 only extends around the back between the oblique muscles, inclusively, while the strap 30 traverses across the abdominal region to provide the same bending movement as the tapered ends 24, 26.

When the support belt 12 is placed around a person's waist the end portions 24, 26 are drawn in toward each other by the strap 30. The fastening strap 30 comprises a flexible, either stretchable or non-stretchable cloth, fabric, nylon, leather or similar material with hook and loop fastening material on both its inner and outer sides 34, 32 and the strap 30 is permanently attached to the belt 12 extending beyond the first end 24. The fastening strap 30, more typically, may be an extension of the hook and loop fastener 28 sewn to the outer surface 14 of belt 12 for ease and efficiency of manufacturing. As noted above, to facilitate secure fastening of the belt around a wearer's waist, the fastening strap 30 is furnished with hook and loop lining on both its inner side 34 and its outer side 32. In the preferred embodiment, the inner side 34 is lined with loop fastener 34*a* for releasably attaching to the support belt fastener 28 which comprises hook. Likewise, the strap outer side 32 is lined with hook so as to provide 360° of hook fastening material when wearing the belt for attaching outer belts having loop fastener liners. Of course, either hook or loop may be secured any of the surfaces so long as proper hook and loop attachments are being facilitated.

At least one buckle 40, or attaching ring, is permanently secured to the outer surface of the support belt 12 proximal the second end portion 26 in the preferred embodiment. The buckle securing member 40 comprises an attaching ring that receives the fastening strap 30 when the strap free end 31 is pulled through the ring 40. In a first position, the fastening strap 30 is fed through the buckle 40, free end 31 first, such that the inner side 34 is facing in the same direction as the hook fastener 28 located on the support belt 12. In a second position, the strap 30 is pulled back against the buckle 40 drawing the second end 26 toward the first end of 24 until a snug secure fit is achieved. This allows the inner side 34 of fastening strap 30 to face and engage the belt's outer surface, such that it makes a hook and loop mating connection with the hook and loop fastener 28.

At least one additional, or auxiliary, attaching ring 42 may also be secured a predetermined distance away from the first attaching ring 40 for facilitating the attachment of accessories or feeding the outer belt 112 through when attaching the outer belt to the support belt 12. The attaching rings 40, 42 are secured to the outer surface 14 of the support belt 12 by fabric ring sleeves 38 which are preferably sewn to the outer surface 14 of the belt and formed by a loop sleeve made in the fastener material 28 without hook or loop actually being disposed on the sleeves 38. Accordingly, the attaching rings 40 are mated through the sleeves 38 and are rotatably maintained therein. A rotatable, contiguous ring sleeve 44 may also be provided on the attaching rings 40, 42 to provide a substantially frictionless surface wherein the ring sleeves 44 spin when feeding the strap 30 through ring 40 and the belt 112 through the secondary ring 42.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A competition shooter or law enforcement officer support belt for simultaneously supporting a user's lower back and an outer belt and holster system, said support belt comprising:

an elongated support platform having a flexible longitudinal axis, said support platform for wrapping around a user's lower torso;

said support platform comprising a first end, a second end, a generally stiff midsection defined by said support platform between said first and second ends, an inner surface that engages the user's lower torso, an exterior surface, an upper edge and a lower edge;

means for releasably attaching the outer belt and holster system contiguously to said support platform, said means for releasably attaching being permanently attached to said exterior surface of said support platform between said first end and said second end so as to provide a substantially 360° fastening surface when said support platform is wrapped around the user's lower torso;

said midsection having a width being greater than the width of the outer belt as measured between said upper and lower edges so as to simultaneously provide support to the user's lower back while virtually immobilizing the outer belt and holster system with respect to the support platform when said platform is firmly wrapped around the user's lower torso; and means for securing said support platform around the user's lower torso.

2. A support belt as recited in claim 1, wherein said means for releasably attaching comprises a first hook and loop fastening liner permanently attached to said exterior surface between said first and second ends.

3. A support belt as recited in claim 2, wherein said means for releasably attaching further comprises a corresponding second hook and loop fastening liner affixed to the outer belt and holster system, said corresponding second hook and loop fastening liner releasably attaching to said first hook and loop fastening liner.

4. A support belt as recited in claim 1, wherein said means for releasably attaching comprises a hook fastening liner permanently attached to said exterior surface between said first and second ends.

5. A support belt as recited in claim 4, wherein said means for releasably attaching further comprises a corresponding loop fastening liner affixed to the outer belt and holster system, said corresponding loop fastening liner releasably attaching to said hook fastening liner.

6. A support belt as recited in claim 1, wherein said means for securing said support platform comprises:

a flexible strap permanently affixed to said support platform and extending beyond said first end; and second means for releasably attaching said strap to said means for releasably attaching the outer belt and holster system, said second means for releasably attaching causing said first and second ends to be drawn in toward each other when said support belt is being secured around a user's lower torso.

7. A support belt as recited in claim 6, wherein said means for securing said support platform further comprises at least one attaching ring permanently affixed to said support belt proximal said second end, said at least one attaching ring for receiving said strap such that said strap may be fed through said ring and pulled back against said ring and over said first end so as to draw said second end toward said first end before releasably attaching to said means for releasably attaching the outer belt and holster system.

8. A support belt as recited in claim 6, further comprising at least one auxiliary ring permanently affixed to said support platform for receiving said outer belt and shooting accessories.

9. A support belt as recited in claim 6, wherein said second means for releasably attaching comprises hook and loop fasteners permanently affixed to said strap such that said strap releasably attaches to said means for releasably attaching the outer belt and holster system, said strap further providing 360° of hook and loop fastening material together with said means for releasably attaching the outer belt and holster system when said strap is attached to said means for releasably attaching the outer belt and holster system.

10. A support belt as recited in claim 3, wherein said means for securing said support platform comprises:

a flexible strap having an inner side and an outer side, said strap being permanently affixed to said support platform and extending beyond said first end;

a strap inner hook and loop fastening liner permanently affixed to said inner side for releasably attaching to said first hook and loop fastening liner;

a strap outer hook and loop fastening liner permanently affixed to said outer side for releasably attaching to said corresponding second hook and loop fastening liner; and at least one attaching ring permanently affixed to said support belt proximal said second end, said at least one attaching ring for receiving said strap such that said strap may be fed through said ring and pulled back against said ring and over said first end so as to draw said second end toward said first end before releasably attaching said inner side to said first hook and loop fastening liner.

11. A support belt as recited in claim 5, wherein said means for securing said support platform comprises:

a flexible strap having an inner side and an outer side, said strap integrally formed from said hook fastening liner such that said outer side comprises said hook fastening liner, said strap extending beyond said first end;

a strap loop fastening liner permanently affixed to said inner side for releasably attaching to said hook fastening liner; and at least one attaching ring permanently affixed to said support belt proximal said second end, said at least one attaching ring for receiving said strap such that said strap may be fed through said ring and pulled back against said ring and over said first end so as to draw said second end toward said first end before releasably attaching said inner side to said first hook and loop fastening liner.

12. A competition shooter or law enforcement officer support belt for simultaneously supporting a user's lower back and outer belt and holster system, said support belt comprising:

an elongated support platform having a flexible longitudinal axis, said support platform for wrapping around a user's lower torso;

said support platform comprising a first end, a second end, a generally stiff midsection defined by said support platform between said first and second ends, an inner surface that engages the user's lower torso, an exterior surface, an upper edge and a lower edge;

a first hook fastening liner permanently attached to said exterior surface between said first and second ends so as to provide substantially 360° of hook fasteners when said support platform is wrapped around the user's lower torso, said hook fastening liner for releasably attaching the outer belt and holster system contiguously to said support platform;

said midsection having a width being greater than the width of the outer belt as measured between said upper and lower edges so as to simultaneously provide support to the user's lower back while virtually immobilizing the belt and holster system with respect to the support platform when said platform is firmly wrapped around the user's lower torso;

a flexible strap permanently affixed to said support platform and extending beyond said first end, said strap comprising an inner side and an outer side, said inner side lined with loop fasteners for releasably attaching to said first hook fastening liner, and said outer side lined with a second hook fastening liner so as to provide 360° of hook fasteners when said inner side is releasably attached to said first hook fastening liner; and at least one attaching ring permanently affixed to said support belt proximal said second end, said at least one attaching ring for receiving said strap such that said strap may be fed through said ring and pulled back against said ring and over said first end so as to draw said second end toward said first end before releasably attaching said inner side to said first hook fastening liner.

13. A support holster system for competition shooters and law enforcement officers that supports a user's lower back and provides a virtually immobilized holster system, said support holster system comprising:

an elongated support platform having a flexible longitudinal axis, said support platform for wrapping around a user's lower torso;

said support platform comprising a first end, a second end, a generally stiff midsection defined by said support platform between said first and second ends, an inner surface that engages the user's lower torso, an exterior surface, an upper edge and a lower edge;

an outer belt releasably attached to said exterior surface of said support platform;

at least one holster securely mounted on said outer belt between said outer belt and said support belt;

means for releasably attaching said outer belt contiguously to said exterior surface, said means for releasably attaching being permanently attached to said exterior surface of said support platform between said first end and said second end so as to provide a substantially 360° fastening surface when said support platform is wrapped around the user's lower torso;

said midsection having a width being greater than the width of the outer belt as measured between said upper and lower edges so as to simultaneously provide support to the user's lower back while virtually immobilizing said at least one holster with respect to the support platform when said support platform is firmly wrapped around the user's lower torso; and means for securing said support platform around the user's lower torso.

14. A support belt as recited in claim 13, wherein said means for releasably attaching comprises:

a first hook and loop fastening liner permanently attached to said exterior surface between said first and second ends.

a second hook and loop fastening liner affixed to the outer belt so as to correspond with said first hook and loop liner, said second hook and loop fastening liner releasably attaching to said first hook and loop fastening liner.

15. A support belt as recited in claim 13, wherein said means for securing said support platform comprises:

a flexible strap permanently attached to said support platform and extending beyond said first end, said strap having an inner side and an outer side;

a first strap hook and loop fastening liner permanently affixed to said inner side for releasably attaching to said first hook and loop fastening liner on said exterior surface;

a second strap hook and loop fastening liner permanently affixed to said outer side such that said exterior surface provides a 360° hook and loop fastening surface when said inner side is attached to said exterior surface; and at least one attaching ring permanently affixed to said support belt proximal said second end, said at least one attaching ring for receiving said strap such that said strap may be fed through said ring and pulled back against said ring and over said first end so as to draw said second end toward said first end before releasably attaching said inner side to said exterior surface.

* * * * *